US005325461A

United States Patent [19]

Tanaka et al.

[11] Patent Number: 5,325,461

[45] Date of Patent: Jun. 28, 1994

[54] SPEECH SIGNAL CODING AND DECODING SYSTEM TRANSMITTING ALLOWANCE RANGE INFORMATION

[75] Inventors: Yoshinori Tanaka; Yoshihiro Sakai; Yasuko Shirai; Tomohiko Taniguchi; Hideaki Kurihara, all of Kawasaki, Japan

[73] Assignee: Fujitsu Limited, Kawasaki, Japan

[21] Appl. No.: 838,340

[22] Filed: Feb. 20, 1992

[30] Foreign Application Priority Data

Feb. 20, 1991 [JP] Japan ..... 3-026327

[51] Int. Cl.[5] ..... G10L 9/00

[52] U.S. Cl. ..... 395/2.16

[58] Field of Search ..... 381/29-49; 395/216

[56] References Cited

U.S. PATENT DOCUMENTS

| | | | |
|---|---|---|---|
| 3,676,595 | 7/1972 | Dolansky et al. | 179/1 VS |
| 4,809,334 | 2/1989 | Bhaskar | 381/49 |
| 4,985,923 | 1/1991 | Ichikawa et al. | 381/38 |

OTHER PUBLICATIONS

Kroon et al., "A class of Analysis-by-Synthesis Predictive Coders for High Quality Speech Coding at Rates Between 4.8 and 16 Kbits/s", IEEE Journal on Selected Areas in Communications, vol. 6, No. 2, Feb. 1988, pp. 353-363.

Kroon et al., "On Improving the Performance of Pitch Predictors in Speech Coding Systems", Advances in Speech Coding, Kluwer Academic Publishers, Nov. 1991, pp. 321-327.

Cox et al, "Robust CELP coders for noisy backgrounds and noisy channels", *International Conference on Acoustics Speech and Signal Processing*, pp. 739-742, May, 1989.

Nichols, "Pitch-learning algorithm for speech encoders", *Journal of the Acoustical Society of America*, pp. 2289-2290, Dec., vol. 84, No. 6, 1988.

*Primary Examiner*—Michael R. Fleming
*Assistant Examiner*—Michelle Doerrler
*Attorney, Agent, or Firm*—Staas & Halsey

[57] ABSTRACT

A speech signal coding apparatus inputs a pitch period generated by coding a speech signal, and outputs information on a range for said pitch period, together with the pitch period. A speech signal decoding apparatus inputs the pitch period and the above information on the range, and determines whether or not the pitch period is within the range. When the pitch period is determined to be within the range, the speech signal decoding apparatus outputs the above pitch period. When the pitch period is determined not to be within the range, the speech signal decoding apparatus outputs as a pitch period a predetermined value within the range.

15 Claims, 9 Drawing Sheets

SPEECH SIGNAL CODING AND DECODING SYSTEM TRANSMITTING ALLOWANCE RANGE INFORMATION

BACKGROUND OF THE INVENTION (1) Field of the Invention

The present invention relates to a speech signal coding apparatus for encoding a speech signal to compress and transmit speech data, and a speech signal decoding apparatus for decoding the coded speech data to regenerate the speech signal.

(2) Description of the Related Art

In recent typical speech signal coding systems, a short term prediction coefficient is obtained by a short term prediction analysis in a short term prediction filter, a pitch prediction coefficient and a pitch period are obtained by a long-term prediction analysis in a long-term prediction filter, and a prediction residual signal is generated by inverse characteristic filters of the short and long-term prediction filters, and the above short term prediction coefficient, the pitch prediction coefficient, the pitch period, and the prediction residual signal are multiplexed and transmitted. Further, to transmit information on the prediction residual signal more efficiently, a Code-Excited Linear Prediction Coding (CELP) System and a Multi-Pulse Excitation Coding (MPC) System have been proposed. In the Code-Excited Linear Prediction Coding (CELP) System, a prediction residual vector is vector quantized, an index thereof is transmitted, and in the Multi-Pulse Excitation Coding (MPC) System, a prediction residual vector is modelled by a sequence of a limited number of pulses, and an optimum pulse position and an optimum pulse amplitude are transmitted.

However, when the above coding systems are used in situations wherein a transmission line error may occur frequently, such as mobile communication, error correcting coding or correction of a parameter containing an error, are required to prevent degradation of a signal due to the transmission line error.

In the correction of a parameter, a parameter containing an error is corrected by interpolation or extrapolation from the other parameters received at times near the time the parameter containing the error is received. However, the interpolation or extrapolation of parameters degrade a regenerated speech signal when parameters do not contain an error. Therefore, it is desirable to carry out the above operation only for the parameter containing the error.

In particular, in a speech signal coding system wherein a pitch prediction coefficient and a pitch period are obtained by long-term prediction analysis, and transmitted, the pitch period is a most important parameter for a voiced sound portion of a speech signal, and therefore, an error in the pitch period information will seriously degrade the quality of the regenerated sound.

However, since speech signals contain an unvoiced sound, which is non-periodic, the correction of an error by interpolation or extrapolation is difficult for a transmission line error in the pitch period even when the error is detected by an error detecting code in a speech signal decoding apparatus.

SUMMARY OF THE INVENTION

An object of the present invention is to provide a speech signal coding system comprising a speech signal coding apparatus and a speech signal decoding apparatus, wherein the speech signal decoding apparatus can detect and correct an error in information on a pitch period transmitted from the speech signal coding apparatus.

According to the first aspect of the present invention, there is provided a speech signal coding apparatus comprising: a speech signal coding unit for inputting a speech signal, and outputting code information by coding the speech signal, where the code information includes a pitch period obtained by a long-term prediction; and a range information generating unit for inputting the pitch period, and outputting information on an allowance range for the pitch period, where the allowance range contains the above pitch period input thereto, and has a predetermined width.

In the above construction according to the first aspect of the present invention, the above allowance range may include a window containing a fundamental pitch period corresponding to the above pitch period, and at least one additional window containing a pitch period equal to an integer multiple of the fundamental pitch period.

In the above construction according to the first aspect of the present invention, the above speech signal coding unit may comprise a unit for determining whether or not the speech signal has pitch-periodicity, and outputting information indicating that the speech signal has no pitch-periodicity.

According to the second aspect of the present invention, there is provided a speech signal decoding apparatus comprising: a receiving unit for receiving code information by coding a speech signal, where the code information includes a pitch period obtained by a long-term prediction, and information on an allowance range for the pitch period, where the allowance range contains the above pitch period input thereto, and has a predetermined width; a pitch period information examining unit for examining the pitch period to determine whether or not the pitch period is within the allowance range; a pitch period correcting unit for generating and supplying a speech signal regenerating unit with a predetermined value within the allowance range, as a pitch period, instead of the pitch period received by the receiving unit, when the pitch period received by the receiving unit is not within the allowance range, and supplying the speech signal regenerating unit with the above pitch period received by the receiving unit when the pitch period received by the receiving unit is within the allowance range; and the above speech signal regenerating unit for regenerating the speech signal by decoding the code information except that the above pitch period supplied from the pitch period correcting unit, instead of the pitch period received by the receiving unit, is used in the decoding operation.

In the above construction according to the second aspect of the present invention, the code information contains no-pitch-period information indicating that the speech signal has no pitch-periodicity, instead of the pitch period, when the speech signal has no pitch-periodicity; and the above pitch period correcting unit supplies the no-pitch-period information to the speech signal regenerating unit when the no-pitch-period information is received by the receiving unit instead of the pitch period.

According to the third aspect of the present invention, in addition to the above construction according to the second aspect of the present invention, the speech signal decoding apparatus may further comprise: a bit error detecting unit for detecting a bit error in the above information on an allowance range, which is received by the receiving unit; an extrapolating unit for generating and outputting an allowance range by extrapolating from information on allowance ranges received preceding the information on the allowance range in which the error is detected, when the bit error detecting unit detects a bit error in the information on the allowance range; and a selector unit. The selector unit is controlled by the detection result of the bit error detecting unit to select and supply the output of the extrapolating unit to the pitch period correcting unit instead of the information on the allowance range in which an error is detected, when the bit error detecting unit detects a bit error in the information on the allowance range; and to select and supply the information on the allowance range received by the receiving unit, to the pitch period correcting unit, when the bit error detecting unit does not detect a bit error in the information on the allowance range received by the receiving unit. The above pitch period information examining unit determines whether or not the pitch period is within the allowance range supplied from the selector unit.

According to the fourth aspect of the present invention, in addition to the above construction of the second aspect of the present invention, the speech signal decoding apparatus may further comprise: a bit error detecting unit for detecting a bit error in the above information on an allowance range received by the receiving unit; an extrapolating unit for outputting information on an allowance range received preceding the information on the allowance range in which the error is detected, when the bit error detecting unit detects a bit error in the information on the allowance range; and a selector unit. The selector unit is controlled by the detection result of the bit error detecting unit to select and supply the output of the extrapolating unit to the pitch period information examining unit instead of the information on the allowance range in which an error is detected, when the bit error detecting unit detects a bit error in the information on the allowance range, and to select and supply the information on the allowance range received by the receiving unit, to the pitch period information examining unit, when the bit error detecting unit does not detect a bit error in the information on the allowance range received by the receiving unit; and the above pitch period information examining unit determines whether or not the pitch period is within the allowance range supplied from the selector unit.

DESCRIPTION OF THE PREFERRED EMBODIMENTS

Figure 1:
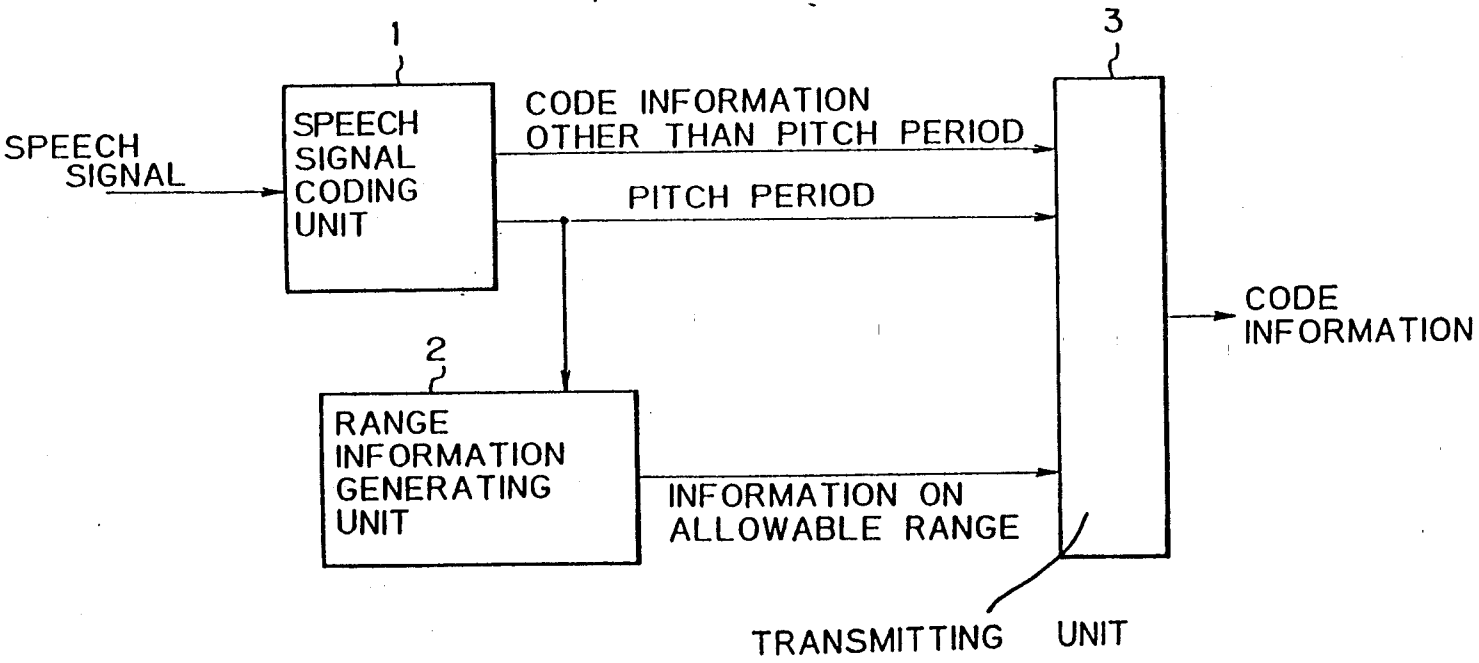
FIG. 1 is a diagram indicating the basic construction of the speech signal coding apparatus according to the first aspect of the present invention.
Figure 2:
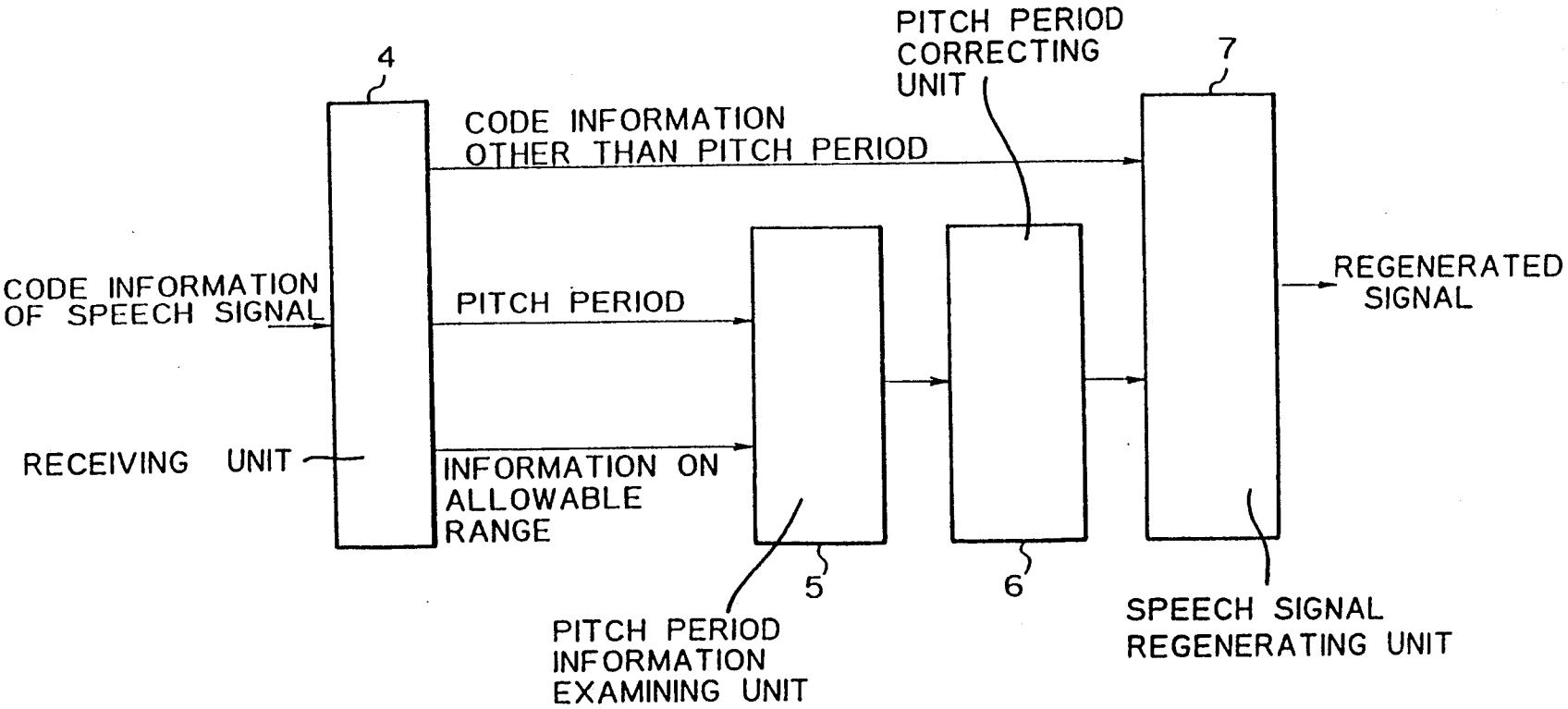
FIG. 2 is a diagram indicating the basic construction of the speech signal decoding apparatus according to the second aspect of the present invention.
Figure 3:
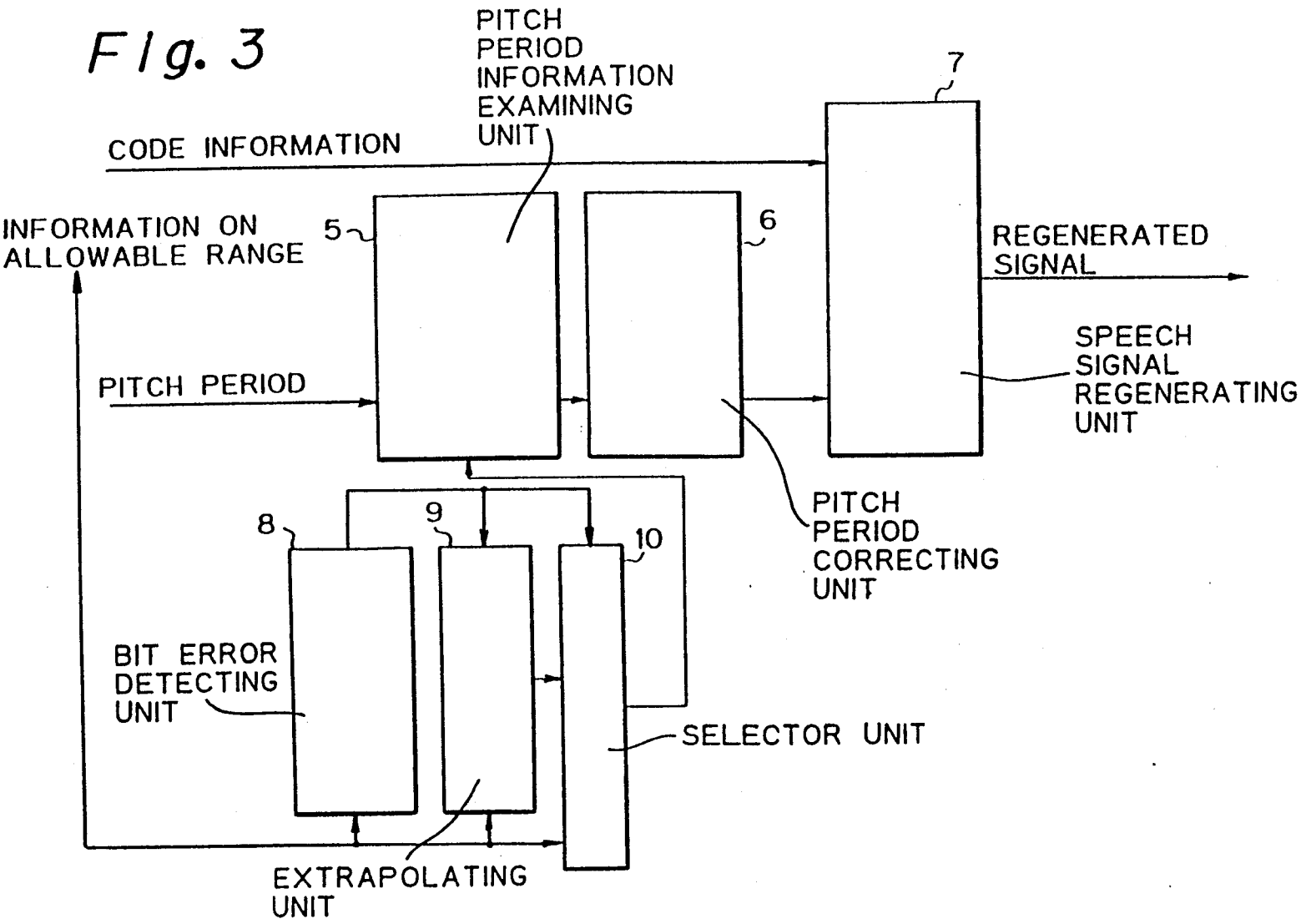
FIG. 3 is a diagram indicating the basic construction for the speech signal decoding apparatus according to the third and fourth aspects of the present invention.

Basic Operations of the Present Invention (FIGS. 1, 2, and 3)

FIG. 1 is a diagram indicating the basic construction of the speech signal coding apparatus according to the first aspect of the present invention. In FIG. 1, reference numeral 1 denotes a speech signal coding unit, 2 denotes a range information generating unit, and 3 denotes a transmitting unit.

According to the first aspect of the present invention, when a speech signal is input into the speech signal coding unit 1, the speech signal is coded to code information including a pitch period by prediction coding in which a long-term prediction analysis is carried out to obtain the pitch period. The pitch period is supplied to the range information generating unit 2, and the range information generating unit 2 outputs information on an allowance range for the pitch period, wherein the allowance range contains the above pitch period input thereto, and has a predetermined width. The above code information including the pitch period and the information on the allowance range are transmitted by the transmitting unit 3.

FIG. 2 is a diagram indicating the basic construction of the speech signal decoding apparatus according to the second aspect of the present invention. In FIG. 2, reference numeral 4 denotes a receiving unit, 5 denotes a pitch period information examining unit, 6 denotes a pitch period correcting unit, and 7 denotes a speech signal regenerating unit.

According to the second aspect of the present invention, code information including a pitch period and information on an allowance range for the pitch period, as obtained by the above construction of the speech signal coding apparatus according to the first aspect of the present invention, are received by the receiving unit 4, and then the pitch period and the allowance range are supplied to the pitch period information examining unit 5 to be examined to determine whether or not the pitch period is within the allowance range. The pitch period correcting unit 6 generates and supplies to the speech signal regenerating unit 7, a predetermined value within the allowance range, as a pitch period, instead of the pitch period received by the receiving unit 4, when the pitch period received by the receiving unit 4 is not within the allowance range, and supplies to the speech signal regenerating unit 7, the above pitch period received by the receiving unit 4 when the pitch period received by the receiving unit is within the allowance range. The above speech signal regenerating unit 7 regenerates the speech signal by decoding the code information except that the above pitch period supplied from the pitch period correcting unit 6, instead of the pitch period received by the receiving unit 4, is used in the decoding operation.

FIG. 3 is a diagram indicating the basic construction for the speech signal decoding apparatus according to the third and fourth aspects of the present invention. In FIG. 3, in addition to the same elements as in FIG. 2, reference numeral 8 denotes a bit error detecting unit, 9 denotes an extrapolating unit, and 10 denotes a select unit.

A bit error in the above information on an allowance range, which is received by the receiving unit, is detected by the bit error detecting unit 8. When the bit error detecting unit 8 detects a bit error in the information on the allowance range, an extrapolating unit 9 generates and outputs an allowance range by extrapolating from pitch periods received preceding a pitch period corresponding to the information on the allowance range in which the error is detected. Based on the detection result of the bit error detecting unit 8, the selector unit 10 selects and supplies the output of the extrapolating unit 9 to the pitch period information examining unit 5 instead of the information on the allowance range in which an error is detected, when the bit error detecting unit does not detect a bit error in the information on the allowance range received by the receiving unit, and selects and supplies the information on the allowance range received by the receiving unit 4, to the pitch period information examining unit 5, when the bit error detecting unit 8 does not detect a bit error in the information on the allowance range received by the receiving unit 4. In this case, the above pitch period information examining unit 5 determines whether or not the pitch period is within the allowance range supplied from the selector unit.

The operations in the fourth aspect of the present invention, are the same as the operations of the above third aspect of the present invention except that the extrapolating unit 9 outputs information on allowance range received preceding the information on the allowance range in which the error is detected, when the bit error detecting unit detects a bit error in the information on the allowance range.

As explained later, the long-term prediction provides good prediction results at pitch periods equal to integer multiples of a fundamental pitch period other than the fundamental pitch period. Therefore, the speech signal coding unit 1 will mostly output a value corresponding to the fundamental pitch period, as an optimum analyzed (predicted) value, but may sometimes output values corresponding to the integer multiples of the fundamental pitch period, as the optimum analyzed (predicted) value. Therefore, the above allowance range may include a window containing the fundamental pitch period and windows respectively containing the integer multiples of the fundamental pitch period, so that the values for the pitch periods corresponding to the integer multiples of the fundamental pitch period, are not determined as an error by the pitch period information examining unit 5 in the speech decoding apparatus.

Further, since generally, speech signals contain unvoiced sounds, no pitch period is detected in the unvoiced sounds. In this case, the speech signal coding unit 1 determines that the speech signal input thereto is an unvoiced signal based on the absence of the pitch-periodicity in the speech signal, and outputs information indicating the absence of the pitch-periodicity, instead of the pitch period. When the above information indicating the absence of the pitch-periodicity is received by the speech decoding apparatus, the pitch period examination unit 5 and the pitch period correcting unit 6 pass the information therethrough to supply the information to the speech signal regenerating unit 7.

Figure 4:
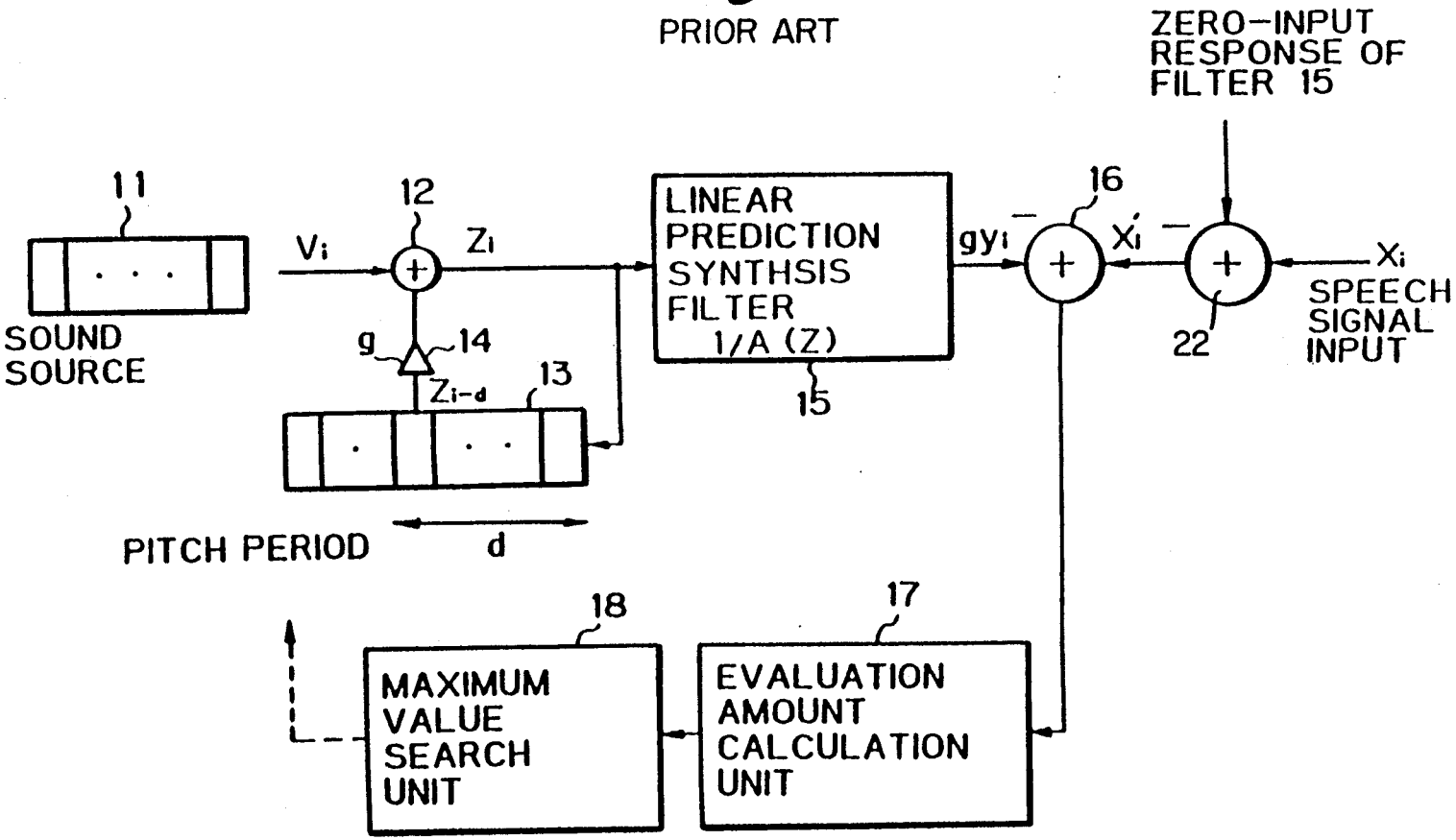
Fig. 4 PRIOR ART
FIG. 4 is a diagram indicating a typical construction of speech signal coding apparatus carrying out an analysis by long-term prediction.
Figure 5:
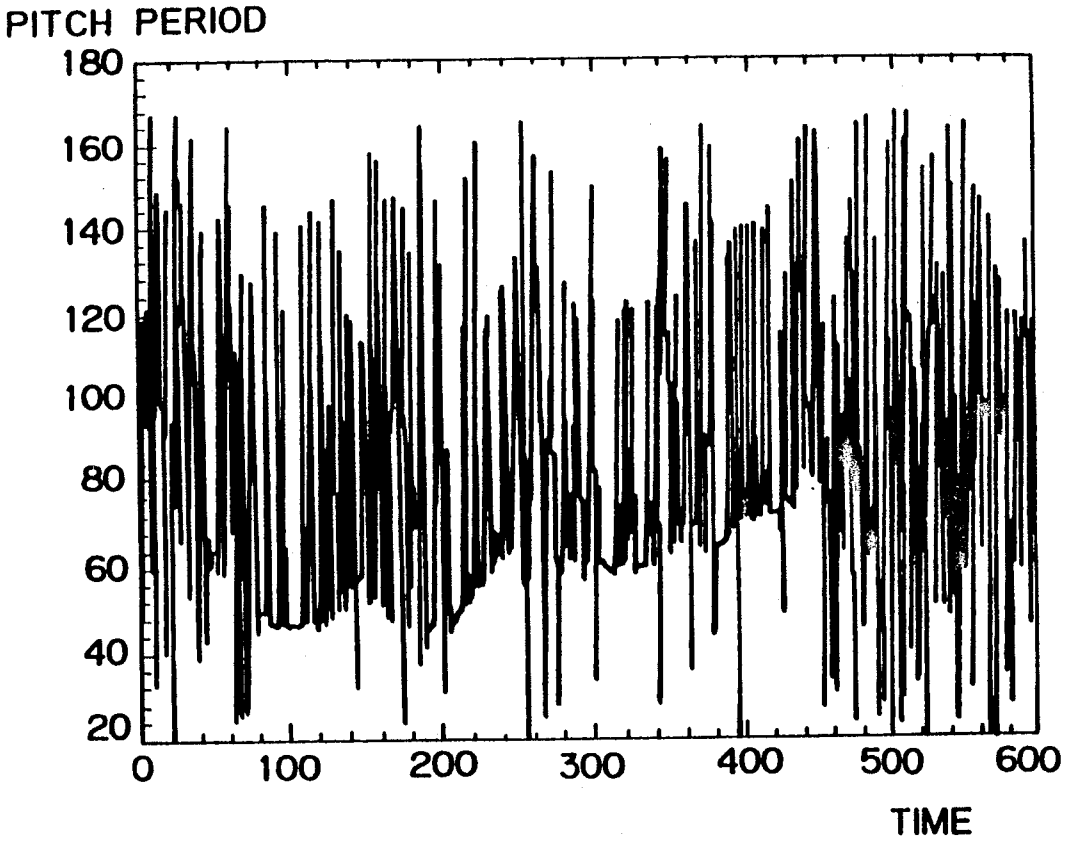
FIG. 5 is a diagram indicating a time trajectory of a pitch period extracted by the Analysis-by-Synthesis procedure.
Figure 6:
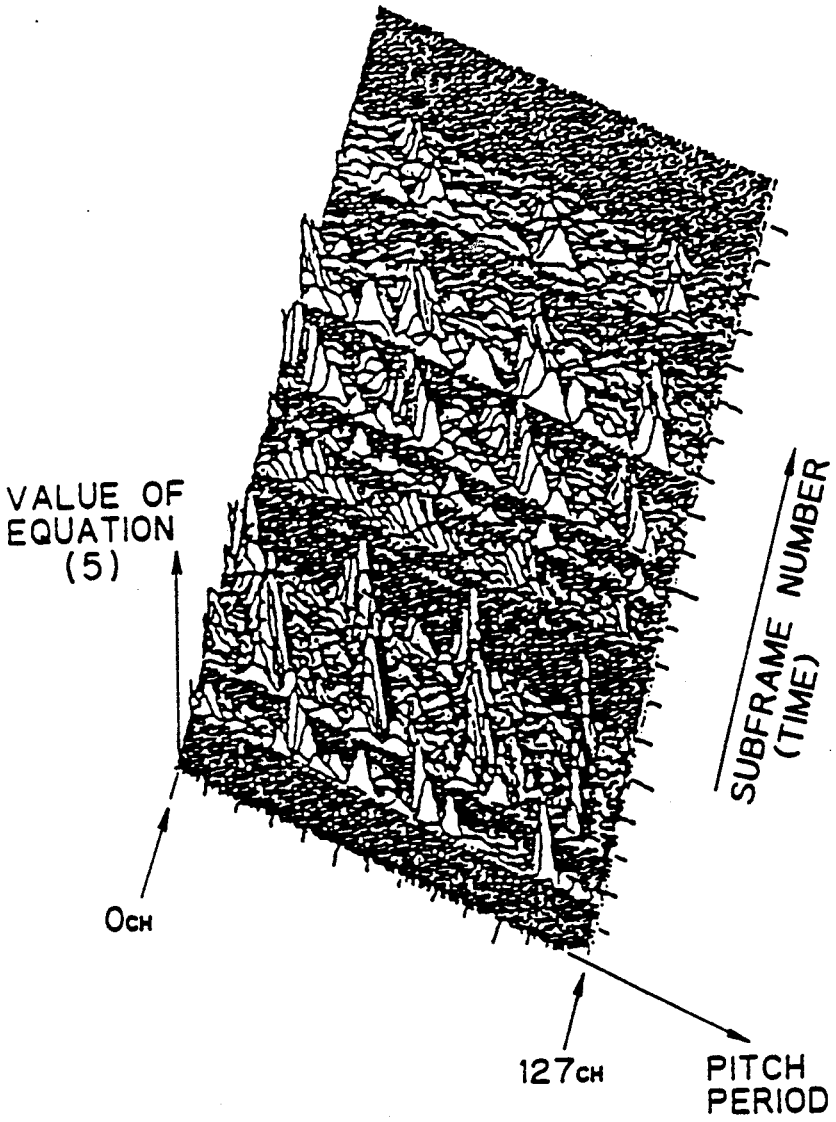
FIG. 6 is a diagram indicating a time-pitch period characteristic of values obtained by the equation (5)

Speech Coding Apparatus Carrying Out Long Term Prediction Analysis (FIGS. 4, 5, and 6)

FIG. 4 is a diagram indicating a typical construction of speech signal coding apparatus carrying out long-term prediction analysis. In FIG. 4, reference numeral 11 denotes an excitation or sound source, 12 denotes an adder, 13 denotes a delay circuit, 14 denotes an amplifier, 15 denotes a linear prediction synthesis filter, 16 denotes a subtracter, 17 denotes an evaluation amount calculating unit, and 18 denotes a maximum value search unit.

The excitation source 11 outputs a vector signal $v_i$, for example, of a Gaussian noise. The adder 12, the delay circuit 13, and the amplifier 14 constitute a long-term prediction filter, and the above vector signal $v_i$ is supplied to the long-term prediction filter. In the long-term prediction filter, the delay circuit 13 delays the output $z_i$ of the adder 12 by d clock cycles, and the output $Z_{i-d}$ of the delay circuit 13 is amplified with a gain gi to supply the output of the amplifier 14 to the adder 12. The adder 12 obtains a sum $z_i$ of the above vector signal $v_i$ and the above output $gi \cdot z_{i-d}$ of the amplifier 14, to supply the sum $z_i$ to the linear prediction synthesis filter 15 as an output of the long-term prediction filter. The characteristic of the linear prediction synthesis filter 15 is expressed by $$1/A(z) = 1/\left(1 + \sum_{i=1}^{p} a_i \cdot z^{-i}\right), \tag{1}$$

where $a_i$'s are prediction coefficients. The linear prediction synthesis filter 15 carries out linear prediction (short-term prediction) based on data of preceding several samples to determine the above prediction coefficients $a_i$. The linear prediction is carried out, for example, once for each speech signal frame.

Usually, a pitch prediction analysis (determination of an optimum pitch period d and an optimum gain g), and a determination of an optimum output of the excitation source 11 will be performed sequentially because simultaneous execution of the pitch prediction analysis and the optimization of the output of the excitation source 11 is costly. In the pitch prediction analysis, the output of the excitation source 11 is set to zero. In addition, data held inside (inside state) of the linear prediction synthesis filter 15 (an influence of a previous frame) is cleared. The zero-state response of the linear prediction synthesis filter 15 for the delayed excitation signal $z_{i-d}$ scaled by gain g can be expressed as $g \cdot y_i(d)$, where $y_i(d)$ is a zero-state response of $z_{i-d}$. The target signal to be predicted by $g \cdot y_i(d)$ is $x_i'$, which is a signal obtained from an actual input speech signal $x_i$ by subtracting a zero-input response of the linear prediction synthesis filter 15. The subtracter 22 is provided to obtain the signal $x_i'$. The subtracter 16 obtains a difference $(x_i' - g \cdot y_i(d))$ between the above target signal $x_i'$ and the output $y_i$ of the linear prediction synthesis filter 15. In this case, an error power is expressed by $$E_d = \sum_{i=1}^{N} (x_i' - g \cdot y_i(d))^2, \tag{2}$$

-continued $$y_i(d) = z_{i-d} + \sum_{j=1}^{p} a_j \cdot y_{i-j}(d),$$

where N is a length of a pitch analysis frame for which one operation of the pitch analysis is carried out, $a_i$'s are the linear prediction coefficients, and p is an order of the linear prediction.

The value of the gain g which gives a minimum value of the equation (2), is obtained by differentiating the equation (2) by g. That is, $$dE_d/dg = 0 \quad (3)$$

$$2 \sum_{i=1}^{N} (x_i' - g \cdot y_i(d)) \cdot y_i(d) = 0$$

$$g = \left( \sum_{i=1}^{N} x_i' \cdot y_i(d) \right) / \sum_{i=1}^{N} |y_i(d)|^2$$

The error power $E_d$ is expressed by $$E_d = \sum_{i=1}^{N} (x_i' - g \cdot y_i(d))^2 \quad (4)$$

$$= \sum_{i=1}^{N} |x_i'|^2 - \left( \sum_{i=1}^{N} x_i' \cdot y_i(d) \right)^2 / \sum_{i=1}^{N} |y_i(d)|^2$$

The first term of the right side of the equation (4) corresponds to a speech vector power, and is constant independent from the delay d. Therefore, a value of the pitch period maximizing the second term of the right side of the equation (4), is an optimum value of the pitch period. Here, the second term of the right side of the equation (4) is expressed by A as below.

$$A = \left( \sum_{i=1}^{N} x_i' \cdot y_i(d) \right)^2 / \sum_{i=1}^{N} |y_i(d)|^2 \quad (5)$$

The evaluation amount calculating unit 17 calculates the above amount A as an evaluation amount. The maximum value search unit 18 scans the delay time d and the gain g in the long-term prediction filter to obtain the optimum values for the delay time d and the gain g which make the evaluation amount A its maximum, i.e., make the error power its minimum. These values are determined as the aforementioned pitch period and the pitch prediction coefficient for every pitch analysis frame. The above procedure is called Analysis-by-Synthesis, and is explained by P. Kroon et al. in "A Class of Analysis-by-Synthesis Predictive Coders for High Quality Speech Coding at Rates Between 4.8 and 16 kbits/s" IEEE Journal on Selected Areas in Communications, Vol. 6, No. 2, pp. 353–363, February 1988, and in "On Improving the Performance of Pitch Predictors In Speech Coding Systems" in "Advances in Speech Coding", pp 321–327, edited by B. S. Atal et al., Kluwer Academic Publishers, 1991.

FIG. 5 is a diagram indicating a time trajectory of a pitch period extracted by the above Analysis-by-Synthesis procedure. Although, generally, speech signals contain a voiced sound portion, and a smooth or constant characteristic curve may be expected, the above Analysis-by-Synthesis frequently extract for example a pitch period two times the duration of the fundamental pitch period, or a pitch period three times the duration of the fundamental pitch period, as shown in FIG. 5. This is because the above evaluation amount A has local minimum values at integer multiples of the fundamental pitch period, other than the fundamental pitch period. FIG. 6 is a diagram indicating a time-pitch period characteristic of values obtained by the equation (5). In FIG. 6, one channel corresponds to eight milliseconds. As shown in FIG. 6, the pitch period value obtained by the Analysis-by-Synthesis varies randomly since the waveform of the evaluation amount A does not indicate the pitch-periodicity. Therefore, conventionally, correction of an error by interpolation or extrapolation is difficult even when a transmission line error is detected in the information on the pitch period transmitted through a transmission line, by use of the error detection code. Thus, conventionally, the correction of an error is not carried out by interpolation or extrapolation, and an error correction code is used for correcting the error.

OUTLINE OF EMBODIMENT OF PRESENT INVENTION

According to the embodiment of the present invention, a pitch analysis is carried out, i.e., a pitch period is obtained by the Analysis-by-Synthesis for every constant period. For example, the pitch analysis is carried out every five milliseconds during one speech signal frame corresponding to 40 milliseconds, where one speech signal frame corresponds to five pitch analysis frames.

Generally, a fundamental pitch period in a voiced portion of a speech signal varies slowly. The optimum pitch period extracted by the Analysis-by-Synthesis, is a pitch period where a square of a correlation between an input vector $x_i$ and a pitch vector $y_i$ in each pitch analysis period becomes its maximum, as indicated in the equation (5). The correlation becomes large for integer multiples of the fundamental pitch period, other than the fundamental pitch period. Therefore, one of such integer multiples of the fundamental pitch period may be extracted by the Analysis-by-Synthesis, and the extracted pitch period may vary between the fundamental pitch period and the integer multiples of the fundamental pitch period.

Therefore, in the embodiment of the present invention, a range of the pitch period containing pitch period values obtained during a predetermined number of successive pitch analysis frames is determined, as an allowance range for the pitch period, based on the pitch period values so that the pitch period is allowed to transit between the integer multiples of a fundamental pitch period. Namely, the above allowance range is determined so that the allowance range is comprised of a range (window) containing a fundamental pitch period, and a plurality of ranges (windows) respectively containing integer multiples of the fundamental pitch period, and pitch period values obtained during a predetermined number of successive pitch analysis frames are contained in the allowance range.

Information on the above allowance range is transmitted to the speech decoding apparatus, together with the corresponding pitch period and the other code information. In the speech decoding apparatus, the pitch period is compared with the above allowance range transmitted together with the pitch period to determine whether or not the pitch period is within the allowance range. When the pitch period is not within the allowance range, it is determined that a transmission line error has occurred in the transmitted pitch period, and the pitch period is corrected to a new value within the allowance range, for example, a center value of the range containing the fundamental pitch period.

ALLOWANCE RANGE (FIGS. 7 AND 8)

The above allowance range may be comprised of a set of a plurality of ranges (windows) which respectively contain a fundamental pitch period and integer multiples of the fundamental pitch period, for example, as indicated in Tables 1-1 and 1-2. For example, when a window containing a fundamental pitch period 34 extends from sample No. 30 to 38, a window from sample numbers 64 to 72 containing the two times the fundamental pitch period, and a window from sample 98 to 106 containing the three times the fundamental pitch period, are included in the set of windows. When a different number is assigned to each of a plurality of sets of windows where each set corresponds to a different fundamental pitch period, the number can be used as the information on an allowance range to be transmitted, as explained later with reference to Tables 1-1 and 1-2.

When N bits is used for the information on the allowance range, the allowance range of the pitch period can be quantized to $2^N$ allowance ranges $R_k$ ($k=0, 1, \ldots 2^N-1$). In this case, The windows constituting the respective allowance ranges are defined by the following equations (6) to (8).

When a width (m samples) of each window equal to an odd number of samples, the $2^N$ allowance ranges $R_k$ ($k=0, 1, \ldots 2^N-1$) are defined by $$R_k: n\tau_k-(m-1)/2 \leqq d \leqq n\tau_k+(m-1)/2 (n=1, 2, \ldots) \quad (6)$$

$$\tau_k=kT+20+(m-1)/2 (k=0, 1, \ldots 2^N-1).$$

When a width (m samples) of each window equal to an even number of samples, the $2^N$ windows $R_k$ ($k=0, 1, \ldots 2^N-1$) are defined by $$R_k: n\tau k-m/2 \leqq d \leqq n\tau k+m/2 (n=1, 2, \ldots) \quad (7)$$

$$\tau_k=kT+20+m/2+1 (k=0, 1, \ldots 2^N-1),$$

or $$R_k: n\tau k-m/2 \leqq d \leqq n\tau k+m/2-1 (n=1, 2, \ldots) \quad (8)$$

$$\tau_k=kT+20+m/2 (k=0, 1, \ldots 2^N-1).$$

In the above equations, k is the number identifying respective allowance ranges $R_k$, T is a number of samples by which locations of corresponding windows in adjacent allowance ranges (adjacent sets of windows) are different, $n\tau k-(m-1)/2$ is defined to be more than a lower limit of a total range in which the optimum pitch period is searched, and $n\tau k+(m-1)/2$ is defined to be less than an upper limit of the total range in which the optimum pitch period is searched.

Since, as explained before, there is no pitch-periodicity in the unvoiced portion or a transient portion between an unvoiced portion to a voiced portion, no allowance range can be determined.

Figure 7:
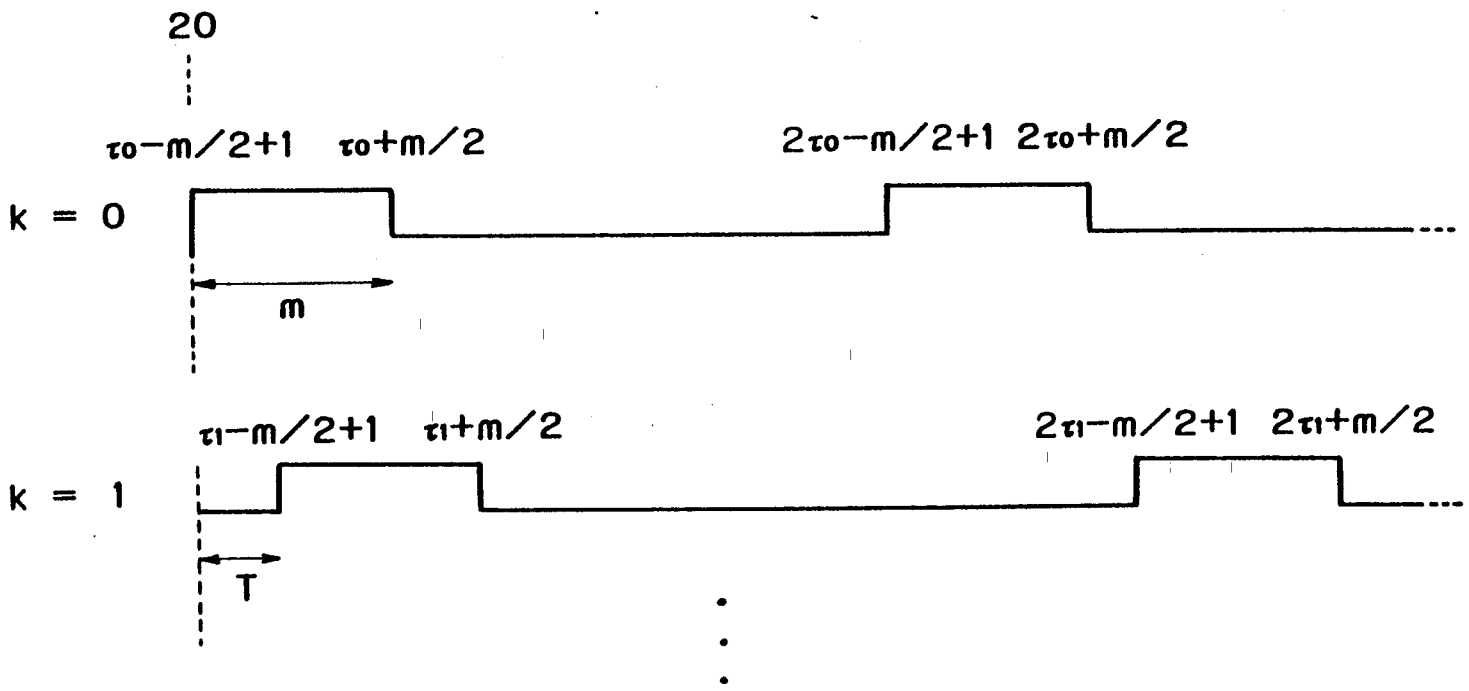
FIG. 7 is a diagram indicating quantization windows according to the equation (7)
Figure 8:
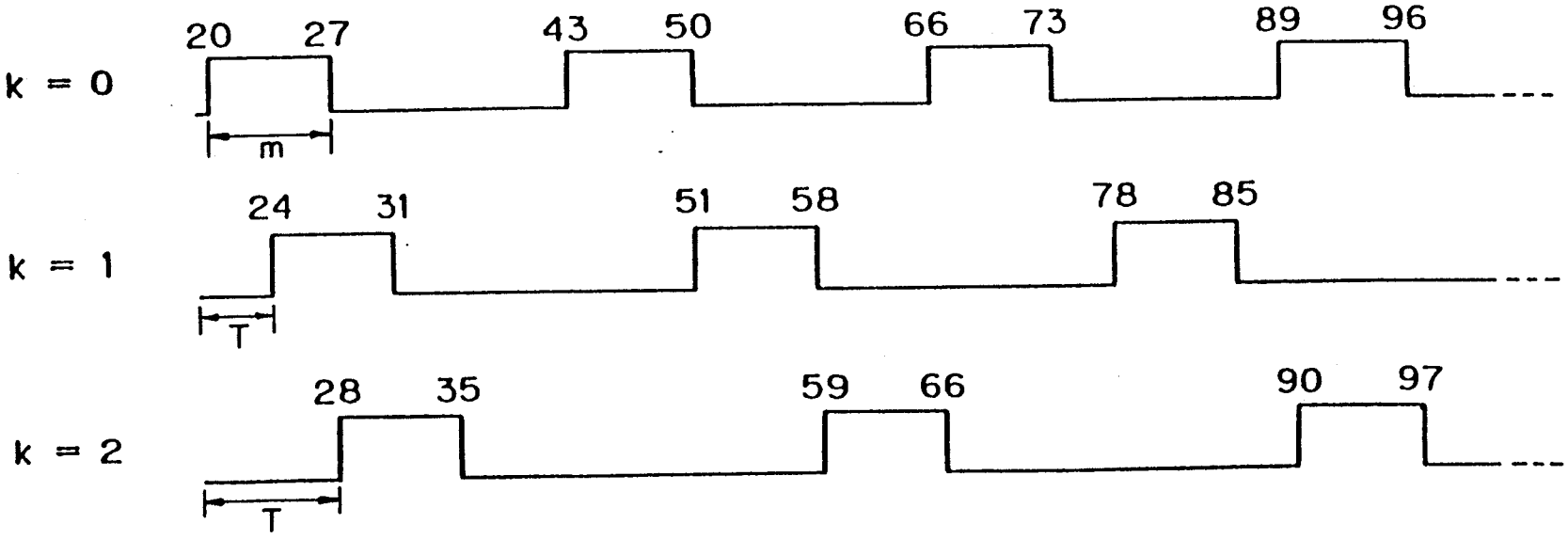
FIG. 8 is a diagram indicating a portion of the windows of Tables 1-1 and 1-2.

FIG. 7 is a diagram indicating quantized windows according to the equation (7). In addition, Tables 1-1 and 1-2 indicate the windows of the quantized allowance ranges $R_k$ according to the equation (7) wherein the number N of bits used for the information on the allowance range, is five; the total range in which the optimum pitch period is searched is set from sample No. 20 to 147; the width m of each window is set to eight samples; and the number T of samples by which locations of corresponding windows in adjacent sets of windows are different is set to four samples. Since $2^N-1=31$, $k=0, 1, \ldots 31$. In the allowance ranges indicated by Tables 1-1 and 1-2, the number $k=31$ is used as the aforementioned information indicating that the speech signal has no pitch-periodicity. FIG. 8 is a diagram indicating a portion of the windows of Tables 1-1 and 1-2.

DETERMINATION OF ALLOWANCE RANGE

As explained before, in the speech coding apparatus, the pitch analysis is carried out for every sub-frame (8 milliseconds) e.g., five times for one speech signal frame (40 milliseconds), to obtain optimum pitch period values $d_i$ ($i=0, 1, 2, 3, 4$) for five sub-frames (pitch analysis frames) in every speech signal frame, and pitch prediction coefficients $g_i$ ($i=0, 1, 2, 3, 4$) respectively corresponding to the optimum pitch period values $d_i$. These optimum pitch period values $d_i$ and the pitch prediction coefficients $g_i$ are transmitted to the speech decoding apparatus, with the other speech signal coding parameters such as LPC coefficients. The above-mentioned Analysis-by-Synthesis is used for the above pitch analysis. Namely, a pitch period value which maximizes the above-mentioned evaluation amount A (by the equation (5)), is determined as the above optimum pitch period value in each pitch analysis frame. Then, an allowance range $R_k$ containing all the optimum pitch period values obtained in one speech signal frame is searched from Tables 1-1 and 1-2.

Since the obtained pitch period values are expected to indicate a relatively smooth characteristic (the pitch period value basically transits between a fundamental pitch period and integer multiples of the fundamental pitch period), the five obtained pitch period values are expected to be contained in one of the allowance ranges $R_k$ ($0, 1, 2, \ldots 2^N-1$) in Tables 1-1 and 1-2. Thus, an allowance range $R_k$ containing the above five pitch period values is determined for each speech signal frame, and transmitted to the speech decoding apparatus together with the other code information.

In the speech decoding apparatus, it is determined whether or not the pitch period is within the allowance range transmitted with the pitch period. When the pitch period is not within the allowance range, it is determined that a transmission line error has occurred in the transmitted pitch period, and the pitch period is corrected to a new value within the allowance range, for example, a center value of the range containing the fundamental pitch period. When the pitch period is within the allowance range, the transmitted pitch period is used for regenerating the speech signal. When the above-mentioned information indicates the absence of the pitch-periodicity, instead of the pitch period, no correcting operation as above is carried out. Thus, according to the present invention, even when the received pitch period contains an error, the received pitch period can be corrected to a value which will be probably near a pitch period value when the value is transmitted from the speech coding apparatus.

Further, the above information on the allowance range may contain an error. When this information contains an error, the pitch period value is incorrectly changed through the above correction process, and the regenerated speech signal is seriously degraded. Therefore, in this embodiment, an error detection code such as a CRC code is added to the information on the allowance range in the speech coding apparatus, and the CRC code is examined in the speech decoding apparatus. When an error is detected in the speech decoding apparatus, a substitute allowance range is obtained in the speech decoding apparatus by extrapolating from allowance ranges received preceding the information on the allowance range in which the error is detected, or an allowance range received preceding the information on the allowance range in which the error is detected is used as the substitute allowance range.

OPERATION IN SPEECH DECODING APPARATUS (FIG. 9)

Figure 9:
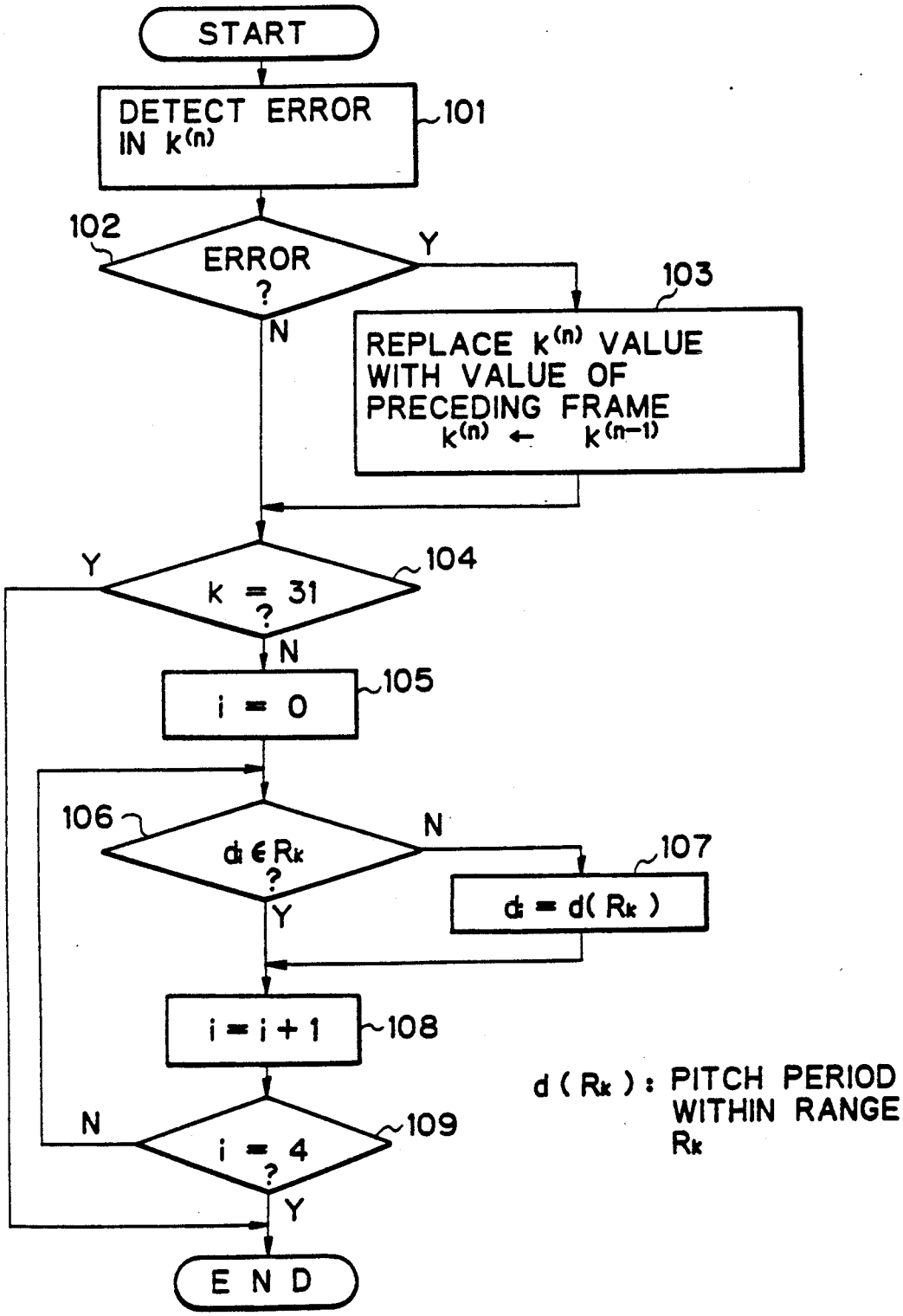
FIG. 9 is a flowchart indicating an operation in the speech decoding apparatus in the embodiment of the present invention.

FIG. 9 is a flowchart indicating an operation in the speech decoding apparatus in the embodiment of the present invention, where allowance ranges $R_k$ in Tables 1-1 and 1-2 are used as explained above, and the number k is transmitted from a speech coding apparatus as the information on the allowance range.

In FIG. 9, in step 101, information on an allowance range $k^{(n)}$ in n-th frame, received with a pitch period value $d_i$, is examined for a bit error by a CRC check code. When an error is detected in the information on an allowance range $k^{(n)}$, the operation goes to the step 103 to replace the above allowance range $k^{(n)}$ with an allowance range $k^{(n-1)}$ for the preceding frame, received preceding the allowance range $k^{(n)}$, and then the operation goes to the step 104. When no error is detected in step 102, the operation goes to step 104. In step 104, it is determined whether or not the above value $k^{(n)}$ or $k^{(n-1)}$ is equal to 31. When $k^{(n)}$ or $k^{(n-1)}$ is equal to 31, the operation of FIG. 9 is completed. When $k^{(n)}$ or $k^{(n-1)}$ is not equal to 31, the operation goes to step 105 to set an index i equal to zero. Then, in step 106, it is determined whether or not the above pitch period value $d_i$ is contained in the allowance range $R_k$ corresponding to the above $k^{(n)}$ or $k^{(n-1)}$. When the above pitch period value $d_i$ is not contained in the above allowance range $R_k$, the pitch period value $d_i$ is replaced by a predetermined value $d(R_k)$ for the pitch period in the allowance range $R_k$ in step 107, and then the operation goes to step 108. When the above pitch period value $d_i$ is contained in the above allowance range $R_k$, the operation goes to step 108. In step 108, the above index i is incremented by one, and the operation goes to step 109. In step 109, it is determined whether or not the index i is equal to four, which corresponds to the number of sub-frames in each speech signal frame. When the index i is equal to four, the operation of FIG. 9 is completed. When the index i is not equal to four, the operation goes to step 106 to examine the pitch period value of the next sub-frame.

REALIZATION OF EMBODIMENT

In the speech coding apparatus of FIG. 1, the speech signal coding unit 1 is realized by the construction as indicated by FIG. 4, and the range information generating unit 2 is realized by software, and the detailed operation thereof is explained above. In the speech decoding apparatus of FIG. 2 and 3, the speech signal regenerating unit 7 is realized by a construction comprised of the excitation source 11, the adder 12, the delay circuit 13, the amplifier 14, and the linear prediction synthesis filter 15. The pitch period information examining unit 5, the pitch period correcting unit 6, the bit error detecting unit 8, the extrapolating unit 9, and the selector unit 10, are respectively realized by software, and the detailed operations thereof are explained above.

TABLE 1-1

| k | WINDOWS IN ALLOWABLE RANGES Rk<br>WINDOWS (IN CHANNEL) | | | | | |
|---|---|---|---|---|---|---|
| 0 | 20–27 | 43–50 | 66–73 | 89–96 | 112–119 | 135–142 |
| 1 | 24–31 | 51–58 | 78–85 | 105–112 | 132–139 | |
| 2 | 28–35 | 59–66 | 90–97 | 121–128 | | |
| 3 | 32–39 | 67–75 | 102–109 | 140–147 | | |
| 4 | 36–43 | 75–82 | 114–121 | | | |
| 5 | 40–47 | 83–90 | 126–133 | | | |
| 6 | 44–51 | 91–98 | 138–145 | | | |
| 7 | 48–55 | 99–106 | | | | |
| 8 | 52–59 | 107–114 | | | | |
| 9 | 56–63 | 115–122 | | | | |
| 10 | 60–67 | 123–130 | | | | |
| 11 | 64–71 | 131–138 | | | | |
| 12 | 68–75 | 139–146 | | | | |
| 13 | 72–79 | | | | | |
| 14 | 76–83 | | | | | |
| 15 | 80–87 | | | | | |
| 16 | 84–91 | | | | | |
| 17 | 88–95 | | | | | |
| 18 | 92–99 | | | | | |
| 19 | 96–103 | | | | | |

TABLE 1-2

| k | WINDOWS IN ALLOWABLE RANGES Rk<br>WINDOWS (IN CHANNEL) |
|---|---|
| 20 | 20–27 |
| 21 | 24–31 |
| 22 | 28–35 |
| 23 | 32–39 |
| 24 | 36–43 |
| 25 | 40–47 |
| 26 | 44–51 |
| 27 | 48–55 |
| 28 | 52–59 |
| 29 | 56–63 |
| 30 | 60–67 |
| 31 | 64–71 |

We claim:

1. A speech signal coding apparatus for generating and transmitting code information, comprising:

speech signal coding means for inputting speech signals, and outputting code information by coding each speech signal, wherein the code information includes a pitch period obtained by a long term prediction process used in the coding;

range information generating means for inputting each of said pitch periods from said speech signal coding means, and for outputting range information as code information including an allowance range of each of said pitch periods, wherein each allowable range is generated for each corresponding pitch period independent from other pitch periods and wherein each allowance range includes said corresponding pitch period input to said range information generating means and has a predetermined range; and transmission means for receiving the code information from the speech signal coding means and the range information generating means, and for transmitting the code information including each corresponding pitch period and allowance range for the speech signal coding apparatus.

2. A speech signal coding apparatus according to claim 1, wherein each said allowance range includes a window containing a fundamental pitch period corresponding to said pitch period, and at least one additional window containing an additional pitch period equal to an integer multiple of said fundamental pitch period.

3. A speech signal coding apparatus according to claim 1, wherein said speech signal coding means comprises determining means for determining whether said speech signal has pitch periodicity, and for outputting periodicity information which indicates that said speech signal does not have said pitch periodicity.

4. A speech signal decoding apparatus comprising:

receiving means for receiving and outputting code information representative of a coded speech signal, wherein said code information includes a pitch period generated by a long term prediction process, information including an allowance range of said pitch period and other code information, wherein the allowance range includes said pitch period input to said receiving means and has a predetermined width;

pitch period information examining means for receiving said pitch period and said allowance range from said receiving means, for examining said pitch period to determine whether said pitch period is within the allowance range and for outputting an allowance signal when the pitch period is within the allowance range;

pitch period correcting means for receiving said allowance signal from said pitch period information examining means, for generating and for outputting a predetermined value within the allowance range to be used as a new pitch period, instead of said pitch period received by the receiving means when the pitch period received by the receiving means is not within the allowance range, and for outputting said pitch period received by said receiving means when the pitch period received by the receiving means is within the allowance range; and speech signal regenerating means for receiving one of said predetermined value and said pitch period output from said pitch period correcting means and for regenerating said coded speech signal be decoding said code information responsive to said other code information and said one of said predetermined value and said pitch period.

5. A speech signal decoding apparatus according to claim 4, wherein said code information further includes no-pitch-period information indicating that said coded speech signal has no pitch periodicity, instead of the pitch period, when the speech signal does not have the pitch periodicity, and wherein said pitch period correcting means supplies said no-pitch-period information to said speech signal regenerating means when the no-pitch-period information is renwed by said receiving means instead of the pitch period.

6. A speech signal decoding apparatus according to claim 4, further comprising:

bit error detecting means for detecting a bit error in said information including said allowance range, received from said receiving means;

extrapolating means for regenerating and outputting an extrapolated allowance range by extrapolating from previous information including previous allowance ranges received preceding said information including the allowance range in which said bit error is detected, when said bit error detecting means detects said bit error in said information including said allowance range; and selector means, controlled by the detecting of said bit error detecting means, for selecting and supplying the extrapolated allowance range output from said extrapolating means to said pitch period correcting means instead of the information including the allowance range in which said bit error is detected, when said bit error detecting means detects said bit error in said information including said allowance range, and for selecting and supplying the information including the allowance range received by said receiving means, to said pitch period correcting means, when said bit error detecting means does not detect said bit error in the information including the allowance range received by said receiving means, and wherein said pitch period information examining means determines whether said pitch period is within one of the extrapolated allowance and the allowance range supplied from said selector means.

7. A speech signal decoding apparatus according to claim 4, further comprising:

bit error detecting means for detecting a bit error in said information including said allowance range, received from said receiving means;

extrapolating means for outputting previous information including a previous allowance range received preceding said information including the allowance range having said bit error, when said bit error detecting means detects said bit error in said information including the allowance range; and selector means, controlled by the detecting of said bit error detecting means, for selecting and supplying the previous information including said previous allowance range received from said extrapolating means to said pitch period correcting means instead of the information including the allowance range in which said bit error is detected, when said bit error detecting means detects said bit error in said information including the allowance range, and for selecting and supplying the information including the allowance range received by said receiving means, to said pitch period correcting means, when said bit error detecting means does not detect said bit error in the information including the allowance range received by said receiving means, and wherein said pitch period information examining means determines whether said pitch period is within one of the previous allowance range and the allowance range supplied from said selector means.

8. A speech coder, comprising:

an encoder, receiving speech signals, coding each of said speech signals into coded speech signals each including a corresponding pitch period and outputting each of said coded speech signals; and range information generating means for receiving each of said pitch periods from said encoder, for determining a corresponding allowance range of and responsive to each of said pitch periods and for outputting each of said allowance ranges, wherein each allowable range is generated for each corresponding pitch period independent from other pitch periods.

9. A speech coder according to claim 8, wherein said range information generating means includes an error detection code with said allowance range, and outputs said allowance range and said error detection code.

10. A method of coding speech, comprising the steps of:

(a) receiving and coding speech signals into coded speech signals each including a pitch period and outputting the coded speech signals; and (b) determining and outputting an allowance range of and responsive to each pitch period, wherein each allowable range is generated for each corresponding pitch period independent from other pitch periods.

11. A method according to claim 10, wherein said determining and outputting step (b) further comprises the step of outputting an error detection code with said allowance range.

12. A decoder apparatus receiving coded speech including a pitch period, an allowance range and other code information comprising:

pitch generating means for generating and outputting a new pitch period within the allowance range when the pitch period is not within the allowance range, and for outputting the pitch period when the pitch period is within the allowance range; and a decoder, connected to said pitch generating means, decoding the coded speech producing regenerated speech responsive to the other code information and one of the pitch period and said new pitch period.

13. A decoder apparatus receiving coded speech including a pitch period, an allowance range and other code information, comprising:

pitch generating means for generating and outputting a new pitch period within the allowance range when the pitch period is not within the allowance range, and for outputting the pitch period when the pitch period is within the allowance range, wherein the allowance range includes a center value having a fundamental pitch period, and wherein said center value is used as said new pitch period generated by said pitch generating means; and a decoder, connected to said pitch generating means, decoding the coded speech producing regenerated speech responsive to the other code information and one of the pitch period and said new pitch period.

14. A decoding method receiving coded speech including a pitch period, an allowance range and other code information, comprising the steps of:

(a) generating and outputting a new pitch period within the allowance range when the pitch period is not within the allowance range, and outputting the pitch period when the pitch period is within the allowance range; and (b) decoding the coded speech producing regenerated speech responsive to the other code information and one of the pitch period and the new pitch period.

15. A decoding method receiving coded speech including a pitch period, an allowance range and other code information, comprising the steps of:

(a) generating and outputting a new pitch period within the allowance range when the pitch period is not within the allowance range, and outputting the pitch period when the pitch period is within the allowance range, wherein the allowance range includes a center value having a fundamental pitch period, and wherein said generating step (a) generates a new pitch period using the center value; and (b) decoding the coded speech producing regenerated speech responsive to the other code information and one of the pitch period and the new pitch period.

* * * * *

UNITED STATES PATENT AND TRADEMARK OFFICE

CERTIFICATE OF CORRECTION

PATENT NO. : 5,325,461

DATED : June 28, 1994

INVENTOR(S) : Yoshinori TANAKA et al.

It is certified that error appears in the above-indentified patent and that said Letters Patent is hereby corrected as shown below:

Column 7, Line 66, after "example" insert --,--.

Column 13, Claim 4, Line 63, change "be" to --by--.

Column 14, Claim 5, Line 8, change "renwed" to --received--.

Signed and Sealed this

Twenty-third Day of August, 1994

Bruce Lehman

*Attest:*

BRUCE LEHMAN

*Attesting Officer*

*Commissioner of Patents and Trademarks*